US007601074B1

(12) United States Patent
Michas

(10) Patent No.: US 7,601,074 B1
(45) Date of Patent: Oct. 13, 2009

(54) GOLF PUTTING TRAINING AID

(76) Inventor: Nicholas J. Michas, 8644 Shady Glen Dr., Orlando, FL (US) 32819

( * ) Notice: Subject to any disclaimer, the term of this patent is extended or adjusted under 35 U.S.C. 154(b) by 0 days.

(21) Appl. No.: 12/131,947

(22) Filed: Jun. 3, 2008

Related U.S. Application Data

(60) Provisional application No. 60/941,992, filed on Jun. 5, 2007.

(51) Int. Cl.
*A63B 69/36* (2006.01)

(52) U.S. Cl. ..... 473/266; 473/219; 473/257

(58) Field of Classification Search ..... 473/219, 473/257–270, 273
See application file for complete search history.

(56) References Cited

U.S. PATENT DOCUMENTS

| | | | | |
|---|---|---|---|---|
| 2,750,195 | A | 6/1956 | Ching | |
| 2,992,005 | A | 7/1961 | Lockhart | |
| 3,332,688 | A | 7/1967 | Gevertz | |
| 3,899,180 | A | 8/1975 | Rodman | |
| 4,805,912 | A | 2/1989 | Hickman | |
| D331,437 | S | 12/1992 | Wood | |
| 5,328,186 | A * | 7/1994 | Hanson et al. | 473/218 |
| 5,423,538 | A | 6/1995 | Stewart | |
| 5,443,265 | A | 8/1995 | Wheeler | |
| D372,288 | S | 7/1996 | Deics | |
| 6,179,723 | B1 | 1/2001 | Evans | |
| 6,840,870 | B1 | 1/2005 | Froggatte | |
| D520,096 | S | 5/2006 | Prestwich | |
| 7,048,642 | B2 * | 5/2006 | Burley | 473/270 |
| 2005/0119063 | A1 | 6/2005 | Tupman et al. | |
| 2005/0215342 | A1 * | 9/2005 | Edwards et al. | 473/257 |

* cited by examiner

*Primary Examiner*—Nini Legesse
(74) *Attorney, Agent, or Firm*—Christine Q. McLeod; Busse Wolter Sanks Mora & Maire, PA

(57) ABSTRACT

A golf putting training aid is provided which comprises an elongated outer element having a display area, such as a window, for displaying one of a plurality of putting distance indicia longitudinally disposed on inner element moveable, such as rotatable, within the outer element. A further embodiment comprises a backswing distance indicia portion and a downswing distance indicia portion for one or more putting distances. A method for using the training aid is also provided.

14 Claims, 6 Drawing Sheets

GOLF PUTTING TRAINING AID

This application claims priority to Ser. No. 60/941,992 filed Jun. 5, 2007 incorporated herein by reference.

FIELD OF THE INVENTION

The invention generally relates to golf training aids, and, more particularly, to a golf putting training aid for improving a golfer's putting stroke.

BACKGROUND OF THE INVENTION

Club stroke consistency is key to mastering the game of golf, especially for putting. Both a backstroke, or backswing, distance from an address position relative to a golf ball to be propelled for putting, and a forward stroke, or downswing, distance through the ball affect how far the ball will travel when struck. Accordingly, it is important that a golfer control these aspects of a putting stroke to achieve predictable putting distances. By training both a backstroke swing distance and forward stroke swing distance corresponding to a desired putting distance, improved putting consistency may be realized. In addition, it is important that that a golfer address the ball correctly when putting. For, example, it is desired that a player's line of sight be aligned directly over the ball when addressing the ball to putt. A golf putting training aid that is simple, portable, and easy to use for providing training of these skills is desired.

Putting aids in the art include U.S. Pat. Nos. D520096, 20050119063, 6,840,870, 6,179,723, D372288, 5,443,265, 5,423,538, D331437, 4,805,912, 3,899,180, 3,332,688, 2,992,005, and 2,750,195, incorporated herein by reference.

BRIEF SUMMARY OF THE INVENTION

An embodiment of the invention provides a golf putting training aid comprising an elongated outer element having a display area, such as a window, for displaying one of a plurality of putting distance indicia longitudinally disposed on inner element moveable, such as rotatable, within the outer element. A further embodiment comprises a backswing distance indicia portion and a downswing distance indicia portion for one or more putting distances.

A further embodiment of the invention comprises a golf putting training aid having an elongated inner element disposed within an elongated outer element, wherein the elongated inner element is selectably rotatable within the outer element and comprises a plurality of indicia representing stroke lengths positioned radially about the inner element, wherein the indicia comprise different lengthwise markings corresponding to different stroke lengths; and wherein the elongated outer element comprises a window for viewing a selected one of the plurality of indicia of the inner element. The lengthwise markings may comprise both a backswing distance portion and a downswing distance portion and these portions may be of different colors to help the user better distinguish and visualize the respective portions. The training aid may also include ball alignment indicia between the backswing distance portion and a downswing distance portion to assist a user in properly aligning the ball (such as an enlarged marking or variant color). Similarly, the aid may include marked endpoints indicating the respective ends of the backswing distance portion and the downswing distance portion.

The window of the training aid may be an elongated opening or an elongated transparent/translucent display area for viewing the selected one of the plurality of indicia of the inner element. Generally, each indicia has a width sized in relation to a width of the window so that a single indicia is viewable through the window at a time. The window may include a backswing window portion and a downswing window portion as well as a ball alignment window portion, wherein each of these portions may be visually distinguishable to assist the user. For example, the ball alignment window portion may be enlarged.

The golf putting training aid also has a means for selectable rotation of the inner element within the outer element along an axis of rotation extending substantially parallel to an elongated axis of the outer element (such as a knob, dial, etc.). For example, the aid may include at least one exposed end of the elongated inner element to allow for selectable rotation of the inner element within the outer element. The aid may also include a means to hold the inner element aligned in a desired orientation relative to the outer element (friction, stops, etc.).

The putting training aid may take on a variety of sizes and shapes. For example, the aid may be substantially tubular, wherein the inner and outer elements are cylindrical. Or, the inner element may include multiple radial facets (sides), wherein each facet includes one of the indicia representing stroke length. A base member may be incorporated into or attached to the outer member for resting the training aid on putting surface.

The golf putting training aid may further include a sighting member extending from the training aid positioned over the ball. The sighting member has a blade portion that hangs over the ball and orients parallel with an aiming line, to allow a user to determine wherein the user's line of sight is properly directed over the ball.

Another embodiment of the invention comprises a method to aid in golf putting comprising positioning a putting aid having an elongated outer element having a window for displaying one of a plurality of putting distance indicia longitudinally disposed on inner element rotatable within the outer element; adjusting the inner element to display the indicia for the desired putting distance; aligning a golf ball with the window; addressing the ball by a user; and swinging in accordance with the indicia.

DETAILED DESCRIPTION OF THE INVENTION

Figure 1:
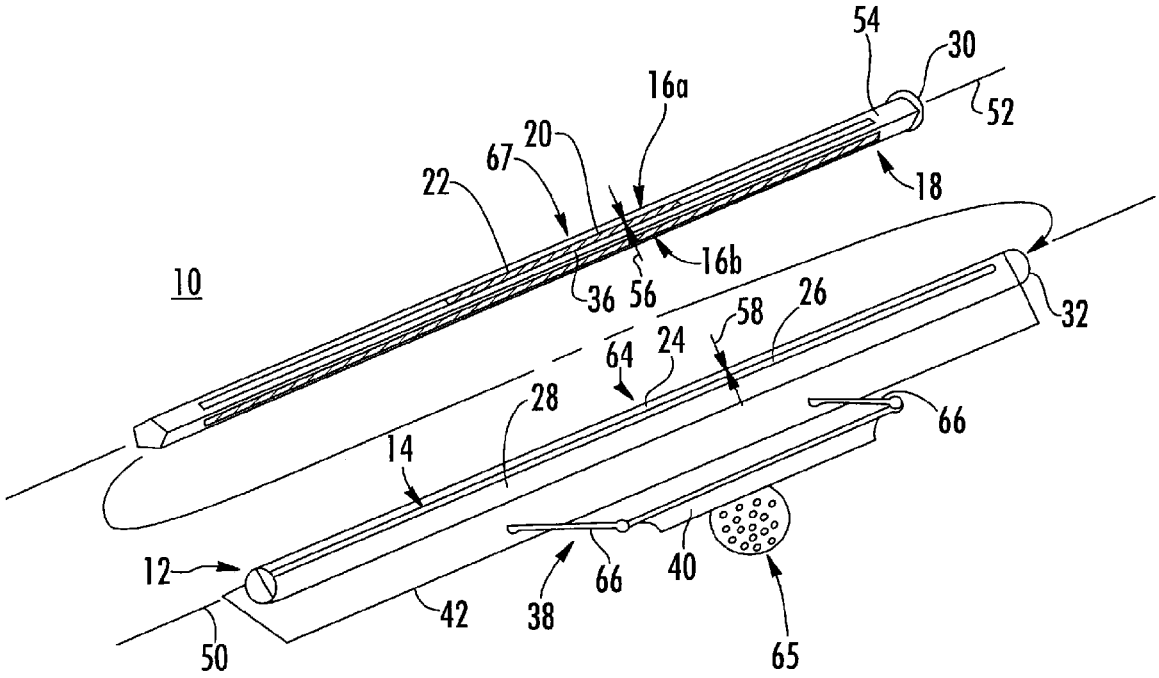
FIG. 1 shows an exploded view of an example embodiment of a golf putting training aid.

A golf putting training aid that is useful for training an appropriate backswing distance and an appropriate downswing distance to achieve a desired putting distance is described herein. As shown in the exploded view FIG. 1, the golf putting training aid 10 may include an elongated outer element 12, such as a tubular element, having a window 14 for displaying one of a plurality of putting distance indicia 16*a*, 16*b* longitudinally disposed on inner element 18 rotatable within the outer element 12. Each indicia 16*a*, 16*b* may include a backswing distance indicia portion 20 and a downswing distance indicia portion 22 for respective putting distances. Each indicia 16*a*, 16*b* may also include a ball alignment indicia portion 36 between the backswing distance indicia portion 20 and the downswing distance indicia portion 22. The window 14 may also include a ball alignment window portion 24, a backswing window portion 26, and a downswing window portion 28.

A user of the training aid 10 rotates the inner element 18, for example by rotating the inner element at one end 30 extending from an end 32 of the outer element 12 until the desired putting distance indicia is displayed in the window 14.

The training aid 10 may also include a sighting member 38 for assisting a user using the aid 10 to properly address the ball 34 when putting. The user places a golf ball 34 in alignment with the ball alignment window portion 24 and/or the ball alignment indicia portion 36 and under a blade portion 40 of the sighting member 38. The user then addresses the ball 34, for example, using the sighting member 38 as a line of sight guide, and putts the ball 34 by using a backswing corresponding to the indicated backswing distance, hitting the ball 34, and then following through the indicated downswing distance.

Figure 2:
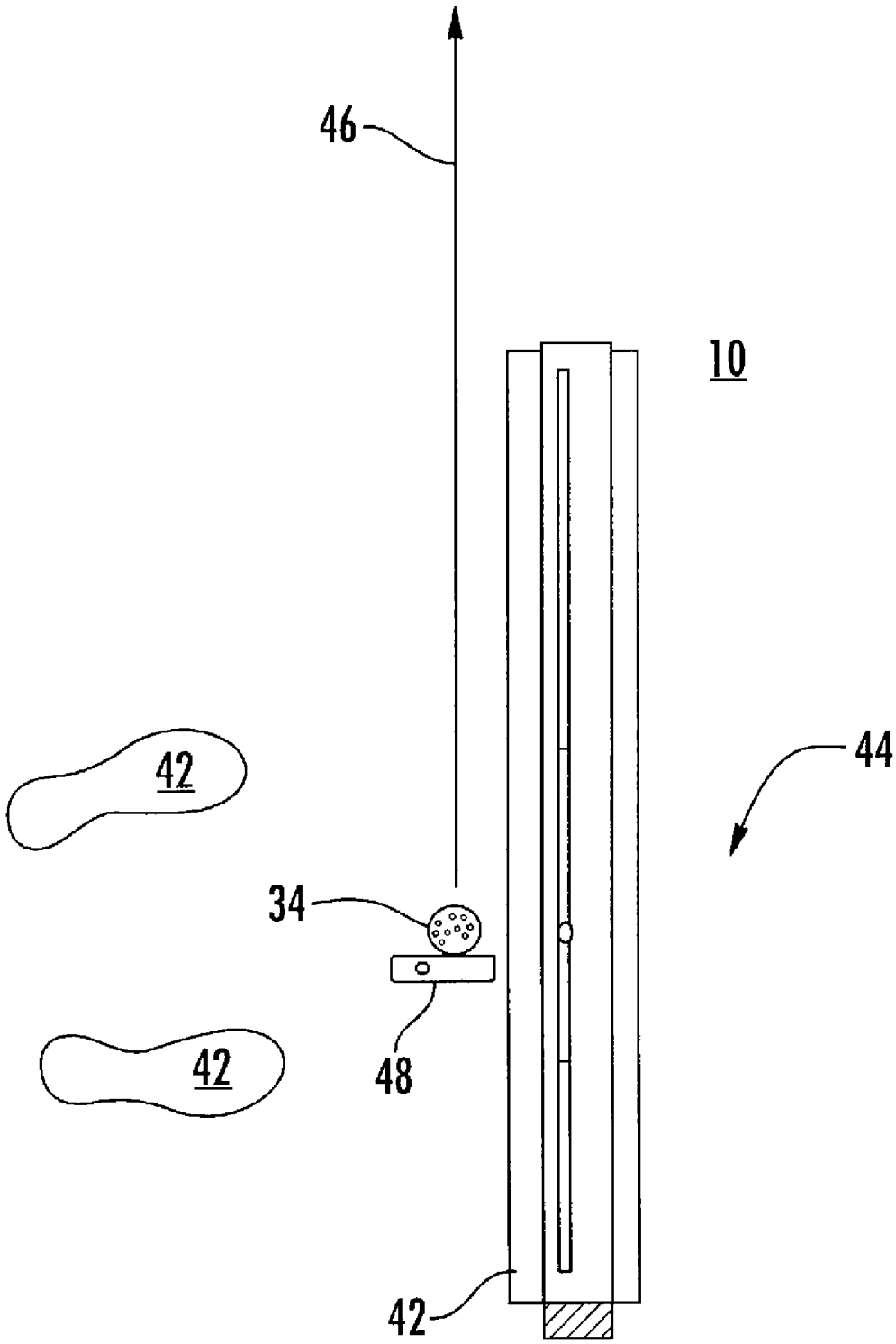
FIG. 2 is a schematic plan view of an example embodiment of a golf putting training aid in relation to a golfer's footprints and a golf ball.

FIG. 2 is a schematic plan view of an example embodiment of the golf putting training aid 10 in relation to a golfer's footprints 42 and a golf ball 34. As shown, the elongated outer element 12 of the training aid 10 may include or incorporate a base 42 for resting the training aid 10 on putting surface 44, for example, alongside and parallel to line 46 along which it is desired to propel the golf ball 24. Club head 48 is illustrated in the address position just behind ball 34, immediately prior to beginning a backswing of a putting stroke. The club head 48 may be a part of a conventional golf club, such as putter. The shaft and handle portions of the golf club attached to the head 48 are conventional, and, accordingly, are not illustrated.

Returning now to FIG. 1, the inner element 18 may be rotatable within the elongated outer element 12 along an axis 52 of rotation extending substantially parallel to an elongated axis 50 of the outer element 12. In an embodiment, the inner element 18 may be configured as a cylinder having a circular cross section with a diameter slightly smaller than an inner diameter of the elongated outer element 12 to allow the inner element 18 to be rotated therein. In another embodiment, the inner element 18 may be configured to have geometric cross section different than a circular cross section, such as a pentagonal, hexagonal octagonal or other cross section. In an aspect of the invention, the geometric cross section of the inner element 18 may be selected to help keep the inner element 18 from inadvertently rotating within the elongated outer element 12 once a desired orientation of the inner element 18 relative to the outer element 12 has been achieved, such as for displaying one of the indicia 16 in the window 14. The inner element 18 may further include a means to hold the inner element aligned in the desired orientation relative to the outer element 12 such as gears, teeth, stops, friction, or the like. Moreover, the inner element 18 may further include a means to rotate the element 18 within the outer element 12 to the desired position, such as an exposed knob, gear, dial, grip, lever, handle, or the like, in communication with the inner element 18 to effect rotation thereof.

Figure 6:
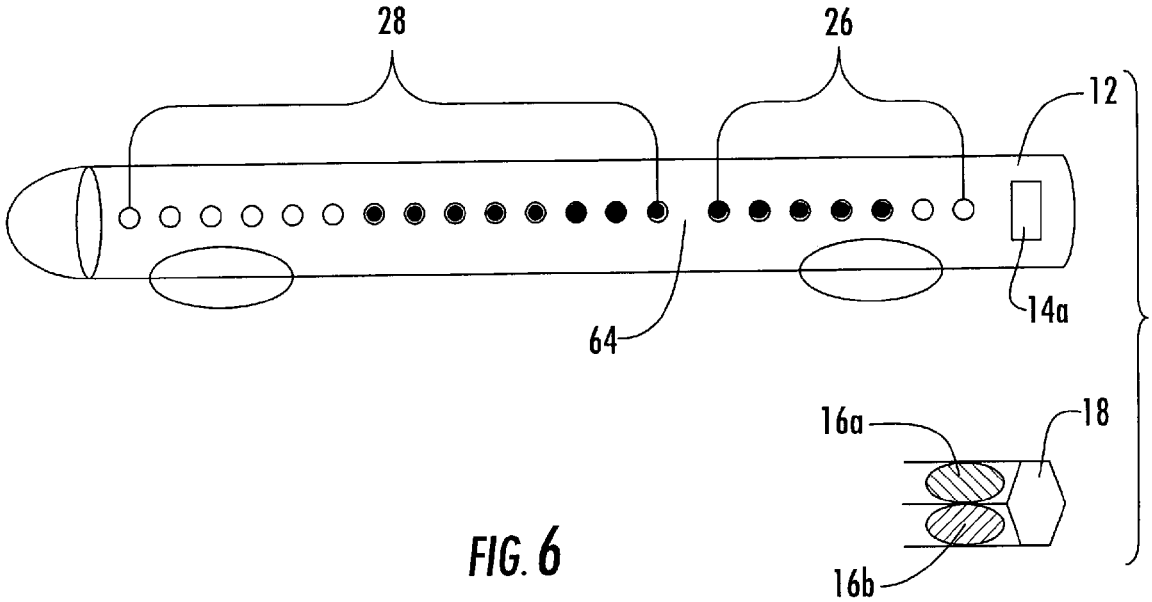
FIG. 6 shows an alternate embodiment of the display window as a series of holes, visually separating the downswing and the follow through with a gap.

The display area/window 14 (such as an opening, a transparent or translucent window, a series of open, transparent or translucent holes/windows [see FIG. 6], etc.) in the elongated outer element 12 may be configured for viewing a longitudinal portion of the inner element 18 therethrough. The window 14 may be positioned in the outer element 12 to allow a user to view the portion of the inner element 18 through the window 14 from a ball address position when using the aid 10 for putting training. In an embodiment, the golf ball 34 may be placed at a point 65 on the putting surface adjacent to a point 64 between the backswing window portion and a corresponding downswing window portion. The window 14 may also include a ball alignment window portion 24, such as an enlarged window portion or other marking/designation, to assist the user in properly aligning the ball in relation to the putting training aid 10. The window 14 may also include a backswing window portion 26 and a downswing window portion 28 separated by a gap or portion such as the ball alignment window portion 24. Window portions 24, 26, and 28 may comprise a single or separate window portions. Ball alignment window portion 24 may be eliminated leaving only a gap between backswing window portion 26 and a downswing window portion 28. The gap may include ball alignment markings instead of a window.

The series of holes forming a window 14 as shown in FIG. 6 may be grouped into a backswing series of holes window portion 26 and a downswing series of holes window portion 28. These holes may be spaced as appropriate, such as every inch or the like. For example, as shown in FIG. 6, if the putting distance calls for 5 inches backswing and 8 inches downswing, 5 holes would appear filled in for the backswing and 8 holes would appear filled in for the downswing. Variant coloring may be used as described herein.

The inner element 18 may include different putting length indicia 16*a*, 16*b* formed on an outer surface 54 of the inner element 18 along a portion of the longitudinal length of the inner element 18 to indicate an appropriate backswing distance and downswing distance for a desired putting range. A width 56 of the indicia 16 may be sized in relation to a width 58 of the window 14 so that a single selected putting length indicia 16 is viewable through the window 14 at a time. Separate indicia 16 may be provided at different radial positions along the inner element 18 for respective different putting ranges.

In another embodiment, the golf ball 34 may be placed at a point 65 on a putting surface adjacent to a point 67 between the backswing portion 20 of the indicia 16 and a corresponding downswing portion 22, such as adjacent to the point 64 indicated by the ball alignment indicia portion 36. The backswing portion 20 of the indicia 16 and a corresponding downswing portion 22 may be of different colors or color shades for visual differentiation.

FIGS. 3A-3E show respective front elevation views of different indicia 16*a*-16*e* viewable through the window 14 of the aid 10 as the inner element 18 is rotated in the outer element 12 to display each of the indicia 16*a*-16*e*. The indicia 16*a*-16*e* shown in the FIG. 3A-3E may include respective backswing portions lengths 60*a*-60*e*, downswing portions lengths 62*a*-62*e*.

Table 1 below tabulates example backswing portions length 60*a*-60*e* measurements and example downswing portions length 62*a*-62*e* measurements for the respective indicia 16*a*-16*e* and approximate putting distances corresponding to the respective indicia 16*a*-16*e*. In addition, Table 1 includes an example indicia for a 32 foot putt that may be used, for example, with an inner element 18 having a hexagonal cross section that may include indicia corresponding to six different putting distances.

This numerical information (such as the putting distances) may be included on or with the training aid 10. For example, a rotatable dial on the end of the aid may include this numerical information to assist the user in selecting the stroke length to be displayed by the aid. Alternately, this corresponding putting distance information may be included as separate indicia on the inner element and may be designed show through a window 14*a* for that purpose. The information may be similarly color coded as described herein.

TABLE 1

| Indicia | Backswing portion length (inches) and example coloring | Downswing portion length (inches) and example coloring | Corresponding Putting Distance feet, approximate) |
|---|---|---|---|
| 16a | 5 (light red) | 8 (dark red) | 6 |
| 16b | 7 (light orange) | 12 (dark orange) | 10 |
| 16c | 9 (light yellow) | 15 (dark yellow) | 14 |
| 16d | 11 (light green) | 17 (dark green) | 18 |
| 16e | 13 (light blue) | 21 (dark blue) | 24 |
| 16f | 15 (light violet) | 24 (dark violet) | 32 |

Figure 3A:
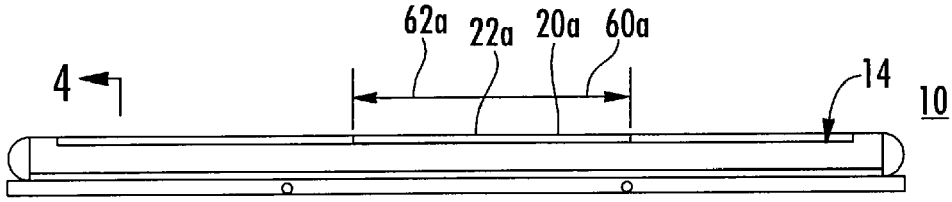
FIGS. 3A-3E show respective front elevation views of different indicia viewed through a window of the golf putting training aid of FIG. 1.
Figure 3B:
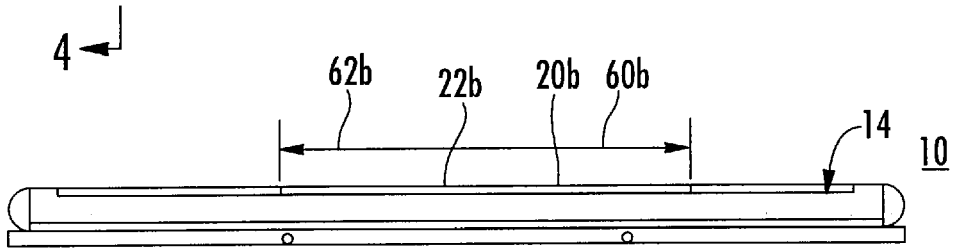
Figure 3C:
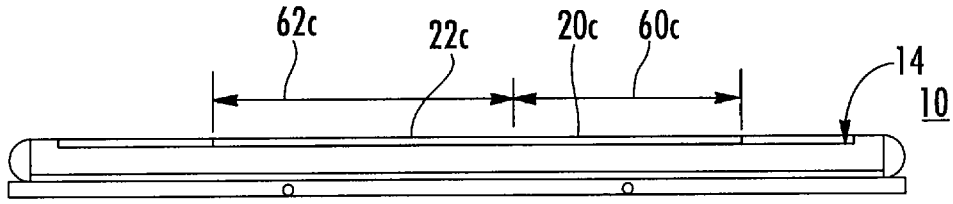
Figure 3D:
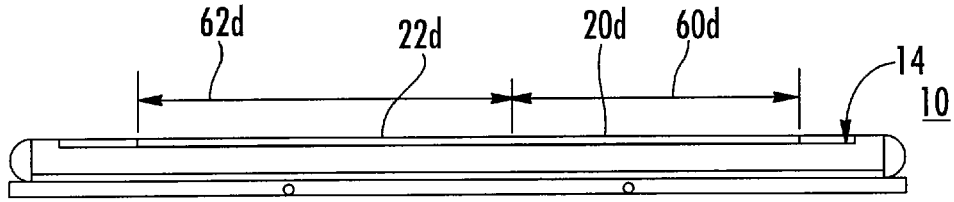
Figure 3E:
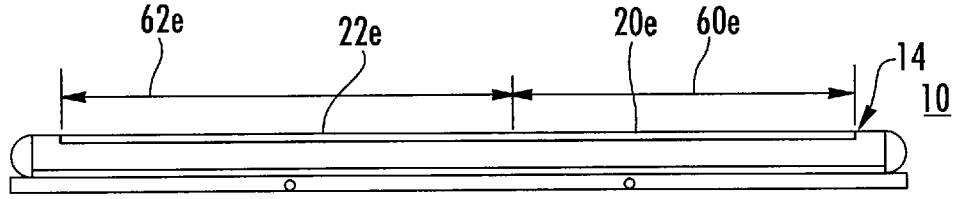

In an example embodiment depicted in FIG. 3C, one or more of the indicia 16*a*-16*e* may include marked endpoints 82*a*, 82*b*, that may include different colored markers, such as bars 84*a*, 84*b*. The marked endpoints 82*a*, 82*b* may be useful for helping a user identify a downswing portion extent and a backswing portion extent, respectively.

Figure 4:
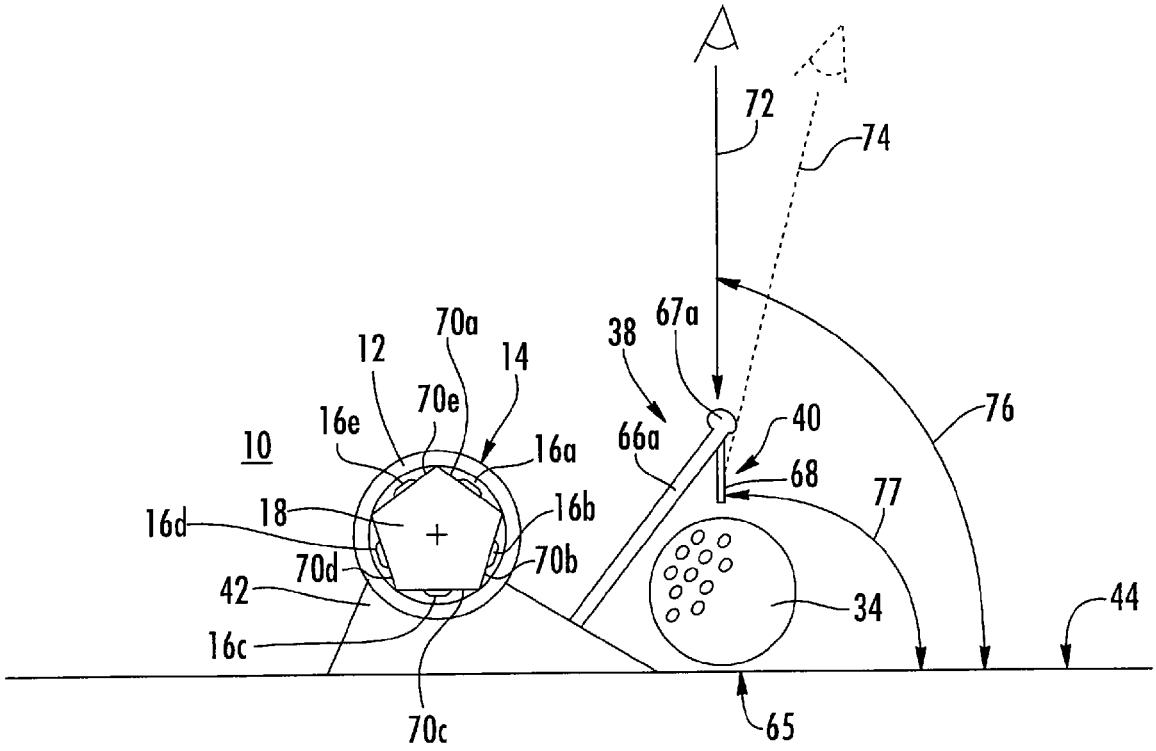
FIG. 4 shows a cross sectional end view of the training aid taken along line 4-4 of FIG. 3*a*.

In another example embodiment depicted in the cross sectional view of FIG. 4, the inner element 18 may include a pentagonal cross section with each face 70*a*-70*e* of pentagon including a respective indicia 16*a*-16*e*. For example, by rotating the pentagonal inner element 18 so the respective faces 70*a*-70*e* are successively rotated into alignment with the window 14, five of the indicia 16*a*-16*e* shown in FIGS. 3A-3E may be displayed. In an aspect of the invention, the respective indicia 16*a*-16*e* may include features that distinguish them from one another, such as by having a different color for each indicia 16*a*-16*e*. The inner element 18 may be designed with any number of sides sufficient to display the desired number of indicia, such as a hexagon with 6 sides and 6 indicia, octagon with 8 sides and 8 indicia, etc. Similarly, the inner element 18 may be substantially tubular without discernible sides and still include the desired number of indicia.

Figure 5:
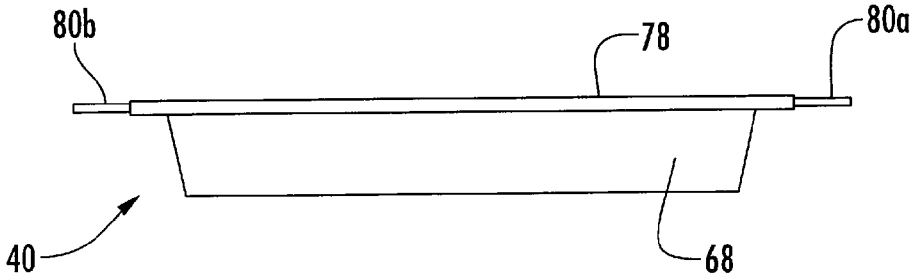
FIG. 5 shows a side elevation view of an example embodiment of a sighting blade that may be used with the golf putting aid of FIG. 1.

In another example embodiment depicted in FIGS. 4 and 5, the putting aid 10 may include the sighting member 38 for assisting a user using the aid 10 to properly address the ball 34. For example, it is desired that a player's line of sight 72 be aligned directly over the ball 34 when addressing the ball 34 to putt. Accordingly, the sighting member 38 may include a blade portion 40 that hangs over the ball 34 and orients parallel with the aiming line 46 of FIG. 2 when the ball 34 is placed adjacent to the aid 10 for putting. The blade portion 40 may be positioned by support arms 66 to extend from the base 42 over the putting point 65. The blade portion 40 may be used to indicate to the user when the user's line of sight 72 is directed over the ball 34, such as at about an angle 76 of about 90 degrees with respect to the playing surface 44, when the user is addressing the ball 34. When the player's line of sight 72 is directly over the ball 34, the blade portion 40 may be arranged so that a user sees an upper edge 78 of the blade portion 40 as shown in FIG. 5.

In an embodiment of the invention, the blade portion 40 may be arranged to pivot longitudinally about respective pivot points 67 of the support arms 66 so that a flat surface 68 of the blade remains at an angle 77 of about a 90 degrees with respect to the playing surface 44. In an aspect of the invention, the blade portion 40 may remain at the angle 77 due to the force of gravity. As shown in FIG. 5, the blade portion 64 may include pivot members 80*a*, 80*b*, such as pins, at respective ends of the blade portion 64 for pivotally connecting to respective support arms 66 at the pivot points 67. If the player's line of sight 74 is not directly over the ball 34 as indicated by dotted line, the flat surface 68 of the blade portion 40 may be viewed, indicating that user's line of sight 74 is not directly over the ball 34. To help the user identify a misalignment condition, the flat surface 68 of the blade may include indicia, such as brightly colored indicia, to allow the user to readily identify a misalignment condition.

Figure 7:
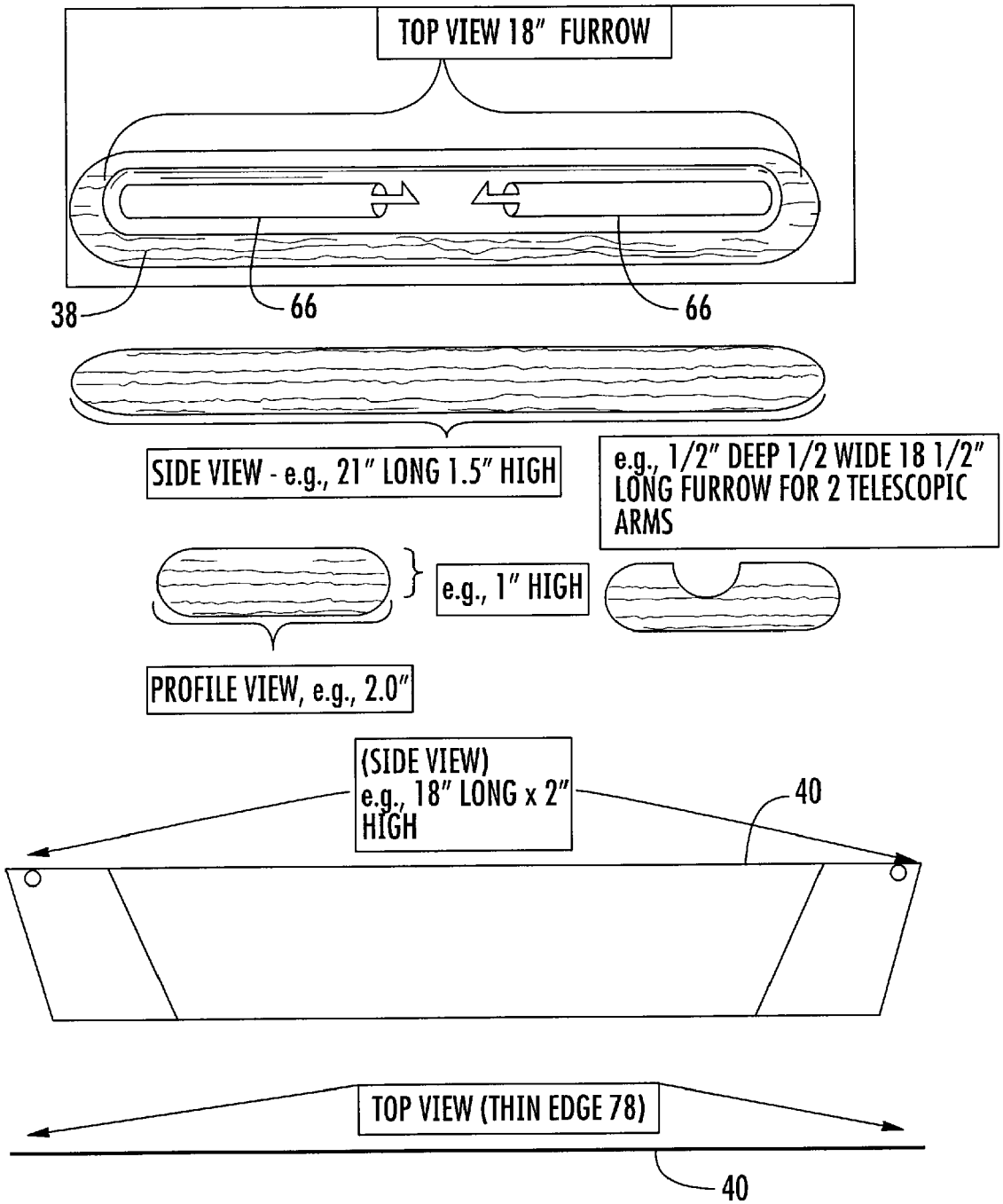
FIG. 7 shows an alternate embodiment of the sighting blade that may be used with the golf putting aid of FIG. 1.

FIG. 7 shows an alternate embodiment of the sighting member 38, which is a free standing device with its own base capable of being used with the golf training aid 10. The free standing sighting member 38 may be placed on the playing surface 44 parallel to the aiming line 46, which is also parallel to the golf training aid 10, and may or may not physically abut the golf training aid 10. Alignment marking may be provided to align the sighting member 38 with the golf training aid. The blade portion 40 may be positioned by support arms 66 which swivel and extend from the base of the sighting member 38. The support arms 66 may comprise two telescoping rods that swivel into place and support the blade 40 over the ball similar to radio antennas with rotating hinge on the bottom. A furrow or narrow groove may be provided in the sighting member's base for storing the telescoping arms. The blade portion 40 may be used as described previously to indicate to the user when the user's line of sight 72 is directed over the ball 34. When the player's line of sight 72 is directly over the ball 34, the blade portion 40 may be arranged so that a user only sees a thin upper edge 78 of the blade portion 40.

While various embodiments of the present invention have been shown and described herein, it will be obvious that such embodiments are provided by way of example only. Numerous variations, changes and substitutions may be made without departing from the invention herein. For example, while the golf training aid is described herein as being used for training putting, one skilled in the art may easily modify the invention for use in training other types of golf swings, such as driving, chipping, etc.

The invention claimed is:

1. A golf putting training aid comprising an elongated inner element disposed within an elongated outer element, wherein the elongated inner element is selectably rotatable within the outer element and comprises a plurality of indicia representing stroke lengths positioned radially about the inner element, wherein the indicia comprise different lengthwise markings corresponding to different stroke lengths; and wherein the elongated outer element comprises a window area for viewing a selected one of the plurality of indicia of the inner element, wherein the inner element comprises a cylinder with multiple sides along its length, wherein each side has one of the indicia representing stroke length along its length.

2. The golf putting training aid of claim 1 wherein the lengthwise markings comprise both a backswing distance portion and a downswing distance portion.

3. The golf putting training aid of claim 2 wherein different coloring or shading is used to demarcate one or more of a backswing distance portion, a downswing distance portion, a ball alignment portion, and each of the plurality of indicia positioned radially about the inner element.

4. The golf putting training aid of claim 2 further comprising marked endpoints indicating the respective ends of the backswing distance portion and the downswing distance portion.

5. The golf putting training aid of claim 1 further comprising ball alignment indicia between the backswing distance portion and a downswing distance portion to assist a user in properly aligning the ball.

6. The golf putting training aid of claim 1 wherein the window comprises an elongated display area for viewing the selected one of the plurality of indicia of the inner element.

7. The golf putting training aid of claim 1 wherein the window further comprises separate backswing window portion and downswing window portion.

8. The golf putting training aid of claim 1 wherein the window further comprises a ball alignment window portion.

9. The golf putting training aid of claim 1 further comprising at least one exposed end of the elongated inner element to allow for selectable rotation of the inner element within the outer element.

10. The golf putting training aid of claim 1 further comprising means to hold the inner element aligned in a desired orientation relative to the outer element.

11. The golf putting training aid of claim 1 wherein the inner element is cylindrical.

12. The golf putting training aid of claim 1 further comprising a base member for resting the training aid on putting surface.

13. A golf putting training aid comprising an elongated inner element disposed within an elongated outer element, wherein the elongated inner element is selectable rotatable within the outer element and comprises a plurality of indicia representing stroke lengths positioned radially about the inner element, wherein the indicia comprise different lengthwise markings corresponding to different stroke lengths; and wherein the elongated outer element comprises a window area for viewing a selected one of the plurality of indicia of the inner element, wherein the window comprises a series of holes arranged along a line for viewing the selected one of the plurality of indicia of the inner element.

14. A golf putting training aid comprising an elongated inner element disposed within an elongated outer element, wherein the elongated inner element is selectable rotatable within the outer element and comprises a plurality of indicia representing stroke lengths positioned radially about the inner element, wherein the indicia comprise different lengthwise markings corresponding to different stroke lengths; and wherein the elongated outer element comprises a window area for viewing a selected one of the plurality of indicia of the inner element, further comprising a sighting member for use with the training aid that is positioned over the ball, wherein the sighting member comprises a blade portion that hangs over the ball and orients parallel with an aiming line, to allow a user to determine wherein the user's line of sight is properly directed over the ball.

* * * * *